United States Patent [19]

Taguchi

[11] Patent Number: 4,639,559

[45] **Date of Patent: * Jan. 27, 1987**

[54] MEMBRANE KEYBOARD

[75] Inventor: Toshimichi Taguchi, Osaka, Japan

[73] Assignee: Sharp Kabushiki Kaisha, Osaka, Japan

[ * ] Notice: The portion of the term of this patent subsequent to Nov. 26, 2002 has been disclaimed.

[21] Appl. No.: 731,273

[22] Filed: May 7, 1985

Related U.S. Application Data

[63] Continuation of Ser. No. 461,148, Jan. 26, 1983, Pat. No. 4,555,601.

[30] Foreign Application Priority Data

Jan. 29, 1982 [JP] Japan ..... 57-13679
Jan. 29, 1982 [JP] Japan ..... 57-13680

[51] Int. Cl.[4] ..... H01H 13/70

[52] U.S. Cl. ..... 200/5 A; 200/86 R; 200/159 B

[58] Field of Search ..... 200/5 A, 86 R, 159 B, 200/308

[56] References Cited

U.S. PATENT DOCUMENTS

| | | | |
|---|---|---|---|
| 3,392,247 | 7/1968 | Check | 200/86 R |
| 3,591,749 | 7/1971 | Comstock | 200/308 |
| 3,699,294 | 10/1972 | Sudduth | 200/86 R X |
| 3,721,778 | 3/1973 | Seeger Jr. et al. | 200/5 A X |
| 3,722,086 | 3/1973 | Wikkerink et al. | 200/86 R X |
| 3,821,500 | 6/1974 | Newman | 200/86 R |
| 4,037,069 | 7/1977 | Gonzalez et al. | 200/86 R |
| 4,145,584 | 3/1979 | Otterlei | 200/5 A |
| 4,345,119 | 8/1982 | Latasiewicz | 200/159 B X |
| 4,375,585 | 3/1983 | Lee | 200/5 A |
| 4,382,165 | 5/1983 | Balash et al. | 200/5 A |
| 4,400,595 | 8/1983 | Ahumada | 200/159 B X |
| 4,471,177 | 9/1984 | Doughty | 200/86 R X |
| 4,555,601 | 11/1985 | Taguchi | 200/5 A |

*Primary Examiner*—J. R. Scott

*Attorney, Agent, or Firm*—Birch, Stewart, Kolasch & Birch

[57] ABSTRACT

A membrane keyboard containing a larger size key pad label and a smaller size key pad labels; a pair of laminate sheets carry confronting conductor electrodes, each of the conductor electrodes being shaped to exactly follow the corresponding key pad label; and spacer sheet disposed between the pair of laminate sheets for electrically separating the confronting conductor electrodes. The spacer sheet is provided with a plurality of openings formed at positions corresponding to each of the conductor electrodes. The openings corresponding to the larger size key pad labels are divided into at least two sections through the use of, for example, a bridge layer extending across the opening, thereby uniforming the key actuation condition.

1 Claim, 4 Drawing Figures

MEMBRANE KEYBOARD

This application is a continution of copending application Ser. No. 461,148 filed on Jan. 26, 1983, U.S. Pat. No. 4,555,601, issued on Nov. 24, 1985.

BACKGROUND AND SUMMARY OF THE INVENTION

The present invention relates to a membrane keyboard panel.

A membrane keyboard has been developed which includes a plurality of laminate flexible polyester film sheets. Key pad labels are.printed on a first sheet, and conductor electrodes are printed on a second sheet at positions corresponding to the key pad labels. Counter conductor electrodes are printed on a third sheet, and a spacer sheet is disposed between the second and third sheets. When a desired key pad label is depressed, the corresponding conductor electrode formed on the second sheet contacts the counter conductor electrode formed on the third sheet through an opening formed in the spacer sheet.

In such a membrane keyboard, it is desirable that a frequently used key is marked by a larger key pad label. Attention should be given to the difference of the pad size in order to ensure an accurate key input operation.

Accordingly, an object of the present invention is to provide a membrane keyboard which includes a larger key pad label and a smaller key pad label.

Another object of the present invention is to provide a membrane keyboard which ensures an accurate key input operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a larger conductor electrode exactly corresponding to the larger key pad label is formed on the second sheet at the corresponding position. Furthermore, a larger counter conductor electrode is formed on the third sheet at the corresponding position, and the spacer sheet has an opening of the size corresponding to the larger key pad label. In a preferred form, the larger opening formed in the spacer sheet is divided into at least two sections, thereby uniforming the pressure required for conducting the key input operation of the respective key pad labels.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
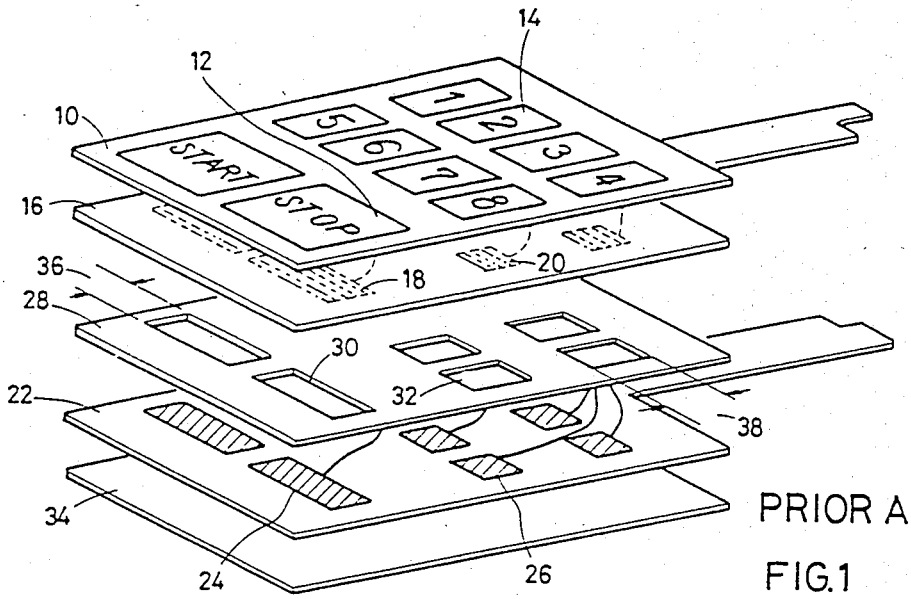
PRIOR ART FIG.1
FIG. 1 is an exploded perspective view of a membrane keyboard of prior art.

In order to facilitate complete understanding of the present invention, a membrane keyboard of prior art will be first described with reference to FIG. 1.

The conventional membrane keyboard includes a flexible polyester laminate sheet 10 which carries key pad labels 12 and 14 printed thereon. Another flexible polyester laminate sheet 16 is disposed under the sheet 10. On the rear surface of the sheet 16, conductor electrodes 18 and 20 are printed at the positions corresponding to the key pad labels 12 and 14. Still another flexible polyester laminate sheet 22 is disposed below the sheet 16. On the front surface of the sheet 22, counter electrodes 24 and 26 are printed at the positions corresponding to the conductor electrodes 18 and 20 formed on the sheet 16. A resin spacer sheet 28 is disposed between the sheets 16 and 22 to electrically separate the electrodes 18 and 20 from the electrodes 24 and 26, respectively.

The spacer sheet 28 is provided with openings 30 and 32 formed at the positions corresponding to the electrodes 18 and 20, respectively. A reinforcing resin plate 34 is disposed at the back of the sheet 22 so as to support the membrane keyboard.

Therefore, when a desired key pad, for example, the key pad 12 is depressed, the conductor electrode 18 formed on the rear surface of the sheet 16 comes into contact with the counter electrode 24 formed on the sheet 22 through the opening 30 formed in the spacer sheet 28.

The above-mentioned membrane keyboard is used in a key input panel of, for example, a microwave oven. In such a case, the "START" key and the "STOP" key are more frequently used than the numeral keys. Therefore, in order to facilitate the key input operation, the key pad 12 is constructed four times larger than the key pad 14. Furthermore, in order to provide uniform key actuation, the opening 30 corresponding to the larger key pad 12 is constructed to have a shorter edge 36 which is substantially identical with a longer edge 38 of the opening 32 which corresponds to the smaller key pad 14.

Accordingly, the actual operating size of the larger key pad is smaller than the key pad label 12. This will cause an inaccurate key input operation.

However, if the opening 30 is constructed to have a size corresponding to the larger key pad 12, it is difficult to determine the characteristics of the sheets 10, 16, 22 and 28. More specifically, if the sheets 10, 16, 22 and 28 are selected to provide a desired key actuation condition at the smaller key pad 14, there is a possibility that the conductor electrode 18 of the larger key pad 12 will normally contact or quite easily contact the counter electrode 24. This will result in an erroneous key input operation. To the contrary, if the sheets 10, 16, 22 and 28 are selected to provide a desired key actuation condition at the larger key pad 12, it is difficult to ensure a stable key input operation at the smaller key pad 14.

Figure 2:
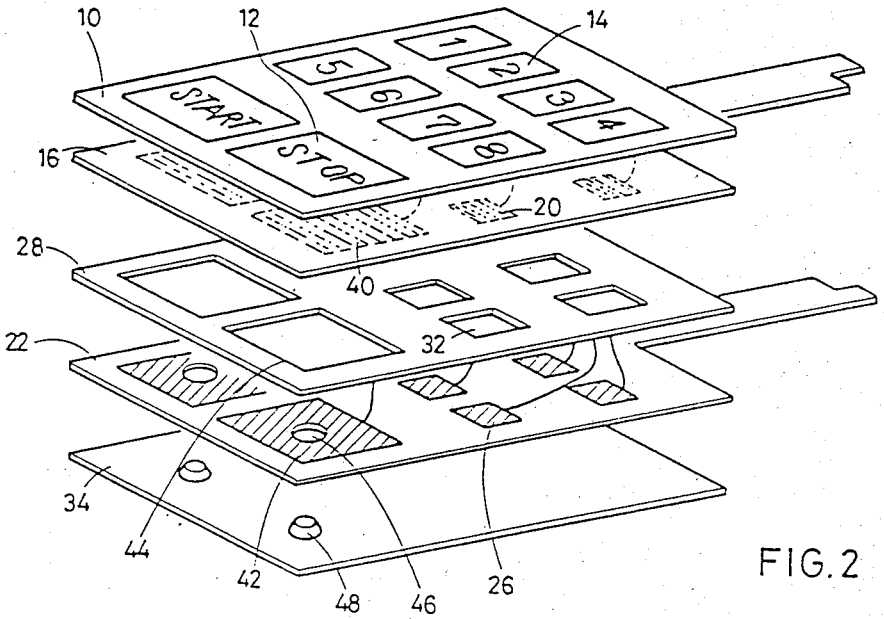
FIG. 2 is an exploded perspective view of an embodiment of a membrane keyboard of the present invention.

FIG. 2 shows an embodiment of a membrane keyboard of the present invention. Like elements corresponding to those of FIG. 1 are indicated by like numerals.

A conductor electrode 40 is formed, through the use of the printing technique, at the rear surface of the flexible polyester laminate sheet 16. The conductor electrode 40 is shaped to be substantially identical with the larger key pad 12. A counter conductor electrode 42 is formed on the front surface of the flexible polyester laminate sheet 22. The counter conductor electrode 42 has a size identical to the conductor electrode 40. The e1ectrodes 40 and 42 are located at the position corresponding to the larger key pad 12. A larger opening 44 is formed in the resin spacer sheet 28, the larger opening 44 having a size substantially identical to the electrodes 40 and 42 and being located at the position corresponding to the electrodes 40 and 42. An opening 46 is formed in the sheet 22 at the position about the center of the counter conductor electrode 42. A protrusion 48 is formed on the reinforcing resin plate 34 at the position corresponding to the opening 46, through the use of, for example, the press technique. The protrusion 48 has a height substantially identical to the total thickness of the sheet 22 and the spacer sheet 28.

The top surface of the protrusion 48 confronts the conductor electrode 40 formed on the rear surface of the sheet 16 through the openings 44 and 46. Thus, the protrusion 48 functions as a partial spacer formed in the spacer sheet 28. Accordingly, an accurate key input operation is conducted when the characteristics of the sheets 10, 16, 22 and 28 are selected so as to ensure an accurate key input operation at the smaller key pad 14.

Figure 3:
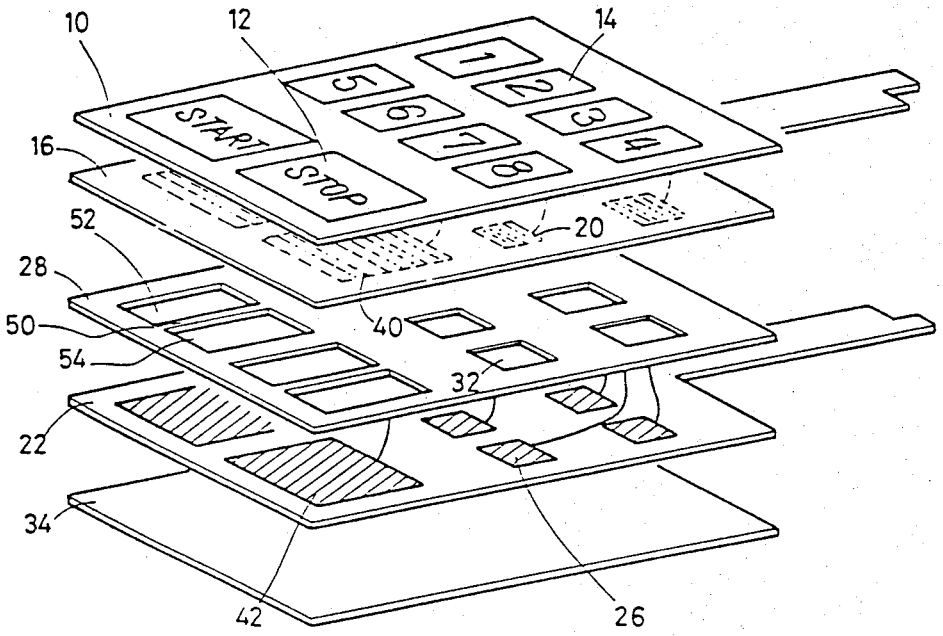
FIG. 3 is an exploded perspective view of another embodiment of a membrane keyboard of the present invention.

FIG. 3 shows another embodiment of a membrane keyboard of the present invention. Like elements corresponding to those of FIG. 2 are indicated by like numerals.

A partition bridge 50 is formed across the larger opening 44 formed in the resin spacer sheet 28 in order to divide the larger opening 44 into two sections 52 and 54. The thus formed partition bridge 50 functions to prevent an erroneous connection of the larger electrodes 40 and 42. Accordingly, the embodiment of FIG. 3 ensures an accurate key input operation and a uniform key actuation condition.

Figure 4:
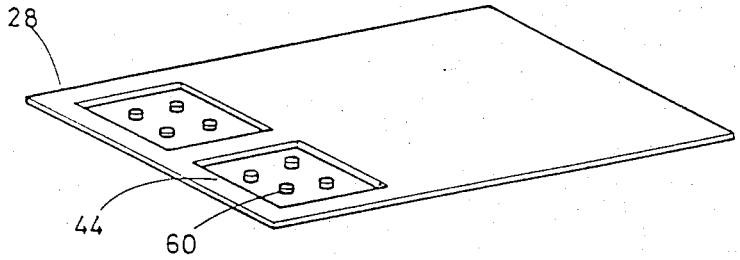
FIG. 4 is a perspective view of an essential part of still another embodiment of a membrane keyboard of the present invention.

FIG. 4 shows an essential part of still another embodiment of a membrane keyboard of the present invention.

A plurality of small island spacers 60 are disposed in the larger opening 44. The island spacers 60 function to preclude the erroneous connection of the electrodes 40 and 42 formed on the sheets 16 and 22, respectively. Accordingly, the embodiment of FIG. 4 ensures a uniform key actuation condition when the characteristics of the sheets 10, 16, 22 and 28 are selected to ensure an accurate key input operation at the smaller key pad 14.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A membrane keyboard comprising:

a first flexible sheet having key pad lables formed thereon, said key pad labels including at least one larger size key pad label and at least one smaller size key pad label;

a second flexible sheet disposed below said first flexible sheet, said second flexible sheet carrying conductor electrodes formed on the rear surface thereof, each of said conductor electrodes having a size substantially identical to the corresponding key pad label formed on said first flexible sheet;

a third flexible sheet disposed below said second flexible sheet, said third flexible sheet carrying counter conductor electrodes formed on the front surface thereof, each of said counter conductor electrodes having a size substantially identical to the corresponding conductor electrode formed on the rear surface of said second flexible sheet;

a spacer sheet disposed between said second and third flexible sheets, said spacer sheet including:

large and small openings formed at positions corresponding to the conductor electrodes formed on the rear surface of said second flexible sheet, each of said openings having a size substantially identical to the corresponding conductor electrode; and a partition bridge member integral with the spacer sheet and formed across the larger opening which corresponds to said larger size key pad label, said partition bridge member dividing the larger opening into two sections, whereby additional support provided for said second flexible sheet by said partition bridge member prevents an erroneous connection between the conductor electrodes and counter conductive electrodes;

and a reinforcing plate disposed below said third flexible sheet.

* * * * *